United States Patent [19]

Merrill et al.

[11] 4,170,563

[45] Oct. 9, 1979

[54] LIQUID ELECTROGRAPHIC DEVELOPER COMPRISING POLYMERIC PHOSPHONATE DISPERSING AGENT

[75] Inventors: Stewart H. Merrill, Rochester; Domenic Santilli, Webster, both of N.Y.

[73] Assignee: Eastman Kodak Company, Rochester, N.Y.

[21] Appl. No.: 824,135

[22] Filed: Aug. 12, 1977

[51] Int. Cl.[2] ..... G03G 9/12

[52] U.S. Cl. ..... 252/62.1 L; 96/1 LY

[58] Field of Search ..... 252/62.1 L, 62.1 R; 96/1 LY

[56] References Cited

U.S. PATENT DOCUMENTS

| | | | |
|---|---|---|---|
| 3,681,243 | 8/1972 | Okuno et al. | 252/62.1 L |
| 3,793,015 | 2/1974 | VanEngeland et al. | 252/62.1 L |
| 3,849,165 | 11/1974 | Stahly et al. | 252/62.1 L |

FOREIGN PATENT DOCUMENTS

| | | | |
|---|---|---|---|
| 51-344 | 1/1976 | Japan | 252/62.1 L |
| 1352067 | 5/1974 | United Kingdom | 252/62.1 L |
| 1436795 | 5/1976 | United Kingdom | 252/62.1 L |

*Primary Examiner*—Roland E. Martin, Jr.
*Attorney, Agent, or Firm*—William T. French

[57] ABSTRACT

Liquid developers for electrography are provided containing soluble polymeric dispersing agents that comprise a phosphonate moiety. The phosphonate moiety comprises a phosphonic acid group, a half-ester of a phosphonic acid group, or a salt of either of these groups.

12 Claims, No Drawings

LIQUID ELECTROGRAPHIC DEVELOPER COMPRISING POLYMERIC PHOSPHONATE DISPERSING AGENT

FIELD OF THE INVENTION

This invention relates to electrography and more particularly to novel liquid developer compositions and their use in the development of electrostatic charge patterns.

BACKGROUND OF THE INVENTION

Electrographic imaging and development processes, e.g., electrophotographic imaging processes and techniques, have been extensively described in both the patent and other literature, for example, U.S. Pat. Nos. 2,221,776, issued Nov. 19, 1940; 2,277,013, issued Mar. 17, 1942; 2,297,691, issued Oct. 6, 1942; 2,357,809, issued Sept. 12, 1944; 2,551,582, issued May 8, 1951; 2,825,814, issued Mar. 4, 1958; 2,833,648, issued May 6, 1958; 3,220,324, issued Nov. 30, 1965; 3,220,831, issued Nov. 30, 1965; 3,220,833, issued Nov. 30, 1965, and many others. Generally, these processes have in common the steps of forming a latent electrostatic charge image on an insulating electrographic element, such as a photoconductive insulating layer coated on a conductive support. The electrostatic latent image is then rendered visible by a development step in which the charge image-bearing surface of the electrographic element is brought into contact with a suitable developer composition.

Many types of developer compositions, including both dry developer compositions and liquid developer compositions, have been proposed heretofore for use in the development of latent electrostatic charge images. Dry developer compositions typically suffer from the disadvantage that distribution of the dry toner powder contained therein on the surface of the electrographic element bearing the electrostatic latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided in the past by the use of a liquid developer of the type described, for example, in Metcalfe et al., U.S. Pat. No. 2,907,674 issued Aug. 6, 1959. Such developers usually comprise an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent.

To achieve suitable physical stability of the toner particles dispersed in conventional liquid electrographic developers, any of several types of various "stabilization" additives are incorporated in such a liquid developer to prevent the toner particles from settling out of the carrier liquid. Typical of such additives are those described in York, U.S. Pat. No. 2,899,335 issued Aug. 11, 1955 and various types of dispersants as described, for example, in British Pat. No. 1,065,796.

One problem which has continued to persist with conventional "stabilized" liquid electrographic developer compositions as described above is that even these "stabilized" compositions, which contain various kinds of stabilization additives, tend to become "deactivated" within a few weeks and the toner particles tend to agglomerate or settle out of the developer. As a consequence, the resultant liquid developer composition containing conventional liquid developer toner particles tends to become incapable of producing electrostatic prints of good quality and density. (See British Pat. No. 1,065,796 noted above). This deactivation of conventional stabilized liquid developers is particularly troublesome because once the toner particles settle out of the developer suspension, it is often difficult to redisperse them. And, even if redispersed, it is often found that the redispersed liquid developer does not possess the same developer characteristics as the original developer.

Developer stability, even in conventional so-called "stabilized" liquid developers has been and is still a difficult problem to overcome. The loss of "stability" which occurs in conventional liquid electrographic developers, as noted hereinabove, occurs primarily in the diluted form of the developer composition which is the "working" form of the developer, i.e., the form of developer composition actually used in most electrographic developing processes. This is one reason, in addition to convenience, that liquid developers are often prepared in the form of so-called "concentrates," i.e., mixtures of resins, pigments and/or dyes with a low liquid content. These concentrates are stable and exhibit a relatively long shelf life.

Stability in "working" liquid developer compositions may be improved to some extent, as noted above in the aforementioned York patent, by the use of various stabilization agents. These additives are most effective in a developer when used in conjunction with toner particles having a very small particle size. It has been difficult to obtain dispersing agents for liquid electrographic developers so that the dispersing agents would produce small toner particles and impart charge uniformly to all of the toner particles in the developer.

Various materials have been suggested in the prior art for dispersing pigments in liquid developers and stabilizing such developers, and such materials have found varying degrees of success. Stahly et al., U.S. Pat. No. 3,849,165 issued Nov. 19, 1974 suggest the use of copolymers having sulfoalkyl groups as dispersing agents for liquid developers. Averbach, U.S. Pat. No. 3,674,693 suggests the use of phospholipids such as lecithin as dispersing agents for liquid developers. Bivalent and trivalent metal salts of phosphorous oxyacid are suggested as dispersing agents for liquid developers in Gilliams et al., U.S. published patent application No. B376,749 published Mar. 30, 1976, and in British Pat. Nos. 1,151,141; 1,411,287; 1,411,537; and 1,411,739.

There is a continuing need to find new and improved dispersing agents that will produce stable, small toner particles having a uniform charge.

SUMMARY OF THE INVENTION

The present invention provides liquid electrographic developers comprising an electrically-insulating carrier liquid containing marking particles and a soluble polymeric dispersing agent that comprises a phosphonate moiety. The phosphonate moiety comprises a phosphonic acid group, a half-ester of a phosphonic acid group, or a salt of either of these groups. The polymeric dispersing agents useful in the liquid electrographic developers of this invention preferably comprise one or more groups having the structure

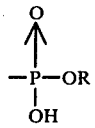

wherein R may be hydrogen, alkyl or aryl, including the substituted forms thereof. The phosphorus atom is covalently bonded to carbon. Particularly useful results are obtained when the phosphonate moiety content of the polymer is from about 0.1% to about 10% by weight, expressed as phorphorus.

DETAILED DESCRIPTION OF THE INVENTION

Liquid electrographic developers of this invention comprising phophonate moiety-containing polymers exhibit excellent dispersion stability and charge stability. The marking particles of these liquid developers further exhibit a relatively uniform triboelectric charge.

As used in the present specification the solubility of a particular polymer or copolymer in a particular developer carrier liquid is defined by the following test. A 4.0 gram quantity of copolymer to be tested is admixed into one liter of a particular developer carrier liquid using a Waring or Polytron Blender operating within the range of 10,000 to 18,000 rpm. This mixture is then centrifuged at 34,000 G forces for about 60 minutes. At the end of this time, the mixture is analyzed to determine the amount of polymer which has precipitated. To form the stable developers of the present invention, it has been determined that useful polymers should be soluble to the extent that at least about 3.3 grams of the original 4.0 gram quantity of polymer remain suspended or dissolved in the carrier liquid after centrifuging. A solubility ratio is then calculated as the amount of polymer which remains suspended in the carrier liquid divided by the 4.0 grams of polymer originally mixed into the carrier liquid. A solubility ratio of 0.825 is equivalent to 3.3 divided by 4.0.

The phosphonate moiety-containing polymers useful in the liquid developers of this invention can be made from any polymerizable phosphonate moiety-containing monomer. Conveniently such useful monomers typically comprise an ethylenically unsaturated double bond to facilitate addition polymerization. Typically, such useful monomers will have one of the following structures:

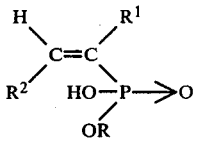

or

-continued

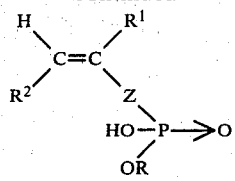

where:

R is the same as defined above;

$R^1$ is hydrogen or a lower alkyl group having 1 to about 4 carbon atoms;

$R^2$ is hydrogen or alkyl; and

Z is alkylene or arylene. Specific examples of such phosphonate moiety-containing monomers useful in the practice of this invention include: ethyl hydrogen p-vinylbenzylphosphonate; ethyl lithium p-vinylbenzylphosphonate; 1-hydroxy-1-methyl-2-propenylphosphonic acid; vinylphosphonic acid; lithium hydrogen vinylphosphonate; etc.

It should be noted that the phosphonate moiety-containing polymers of this invention can also be made by polymerizing monomers that can be phosphorylated. For example, a carbonyl-containing polymer can be phosphorylated by the procedure described by Marvel and Wright in Journal of Polymer Science, Volume 8, p. 495 (1952). Phosphonate moiety-containing polymers made by this or equivalent procedures are contemplated within the scope of this invention.

Any suitable comonomers can be copolymerized with the phosphonate moiety-containing monomers to produce polymers useful in the liquid developers of this invention as long as the resulting polymer has the required solubility as defined above. Representative type A comonomers that can generally be copolymerized with the above phosphonate moiety-containing monomers to form copolymers used in the liquid developers of the invention may be selected from the following materials:

a. alkyl styrenes such as compounds having the formula

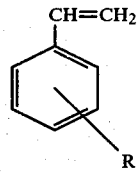

where R is an alkyl having from about 3 to about 10 carbon atoms in the alkyl moiety;

b. alkoxy styrenes such as compounds having the formula

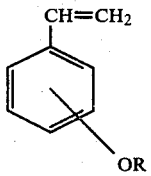

where R is an alkyl having from about 3 to about 10 carbon atoms in the alkyl moiety, for example, p-amyloxystyrene;

c. alkyl acrylates such as compounds having the formula

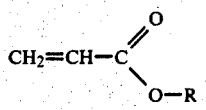

where R is an alkyl having from about 8 to about 22 carbon atoms in the alkyl moiety;

d. alkyl methacrylates such as compounds having the formula

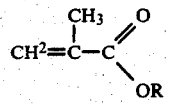

where R is an alkyl having from about 8 to about 22 carbon atoms in the alkyl moiety;

e. vinyl alkyl ethers such as compounds having the formula

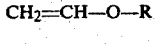

where R is an alkyl having from about 8 to about 22 carbon atoms in the alkyl moiety; and f. vinyl esters of aliphatic acids such as compounds having the formula

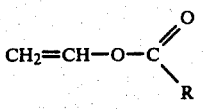

where R is an alkyl having from about 6 to about 22 carbon atoms in the alkyl moiety; and mixtures thereof.

Preferred type A comonomers contained in the copolymers used in the preparation of the liquid developers of the invention generally include the following:

a. alkyl styrenes having from about 5 to about 10 carbon atoms in the alkyl moiety;

b. alkyl acrylates and methacrylates having from about 12 to about 22 carbon atoms in the alkyl moiety; and c. vinyl esters of aliphatic acids having from about 10 to about 22 carbon atoms in the alkyl moiety; and mixtures thereof. Typical type A comonomers groups which can be so used include the following:

4-pentylstyrene
4-hexylstyrene
4-octylstyrene
lauryl acrylate
hexadecyl methacrylate
octadecyl methacrylate
eicosyl acrylate
docosyl methacrylate
vinyl caprate
vinyl laurate
vinyl palmitate
vinyl stearate
vinyl eicosate
vinyl docosate
and mixtures thereof.

Generally, it has been found that if a type A comonomer such as described above is present in the copolymer to the extent of at least about 35 weight percent of the polymer, a copolymer is obtained capable of forming a substantially stable dispersion in a typical carrier liquid. Generally, the phosphonate moiety-containing monomer is present in an amount not in excess of about 20 weight percent of the polymer. If no further monomer moiety is present, then, it is preferred that the type A comonomer be present to the extent of at least about 84 weight percent of the polymer.

Preferred copolymers used in the preparation of the liquid developers of the invention also contain at least one type B comonomer or group copolymerized with the aforementioned phosphonate moiety containing monomer and type A comonomer. Representative type B comonomers which may be suitable for being so copolymerized include the following:

a. styrenes selected from the group of styrene, methylstyrene, methoxystyrene and halogenated styrene;

b. alkyl acrylates having from about 1 to about 4 carbon atoms in the alkyl moiety;

c. alkyl methacrylates having from 1 to about 4 carbon atoms in the alkyl moiety;

d. vinyl alkyl ethers having from 1 to about 4 carbon atoms in the alkyl moiety; and e. vinyl esters of aliphatic acids having from about 1 to about 4 carbon atoms in the alkyl moiety; and mixtures thereof.

Preferred type B comonomers contained in the copolymers used in the preparation of the subject liquid developers generally include the following:

a. styrene and methylstyrene;

b. alkyl acrylates having from 1 to about 4 carbon atoms in the alkyl moiety;

c. alkyl methacrylates having from 1 to about 4 carbon atoms in the alkyl moiety; and d. vinyl esters of aliphatic acids having from 1 to about 4 carbon atoms in the alkyl moiety; and mixtures thereof. Typical type B comonomers or groups which can be so used include the following:

styrene
α-methylstyrene
ethyl acrylate
methyl acrylate
butyl acrylate
ethyl methacrylate
propyl methacrylate
butyl methacrylate
vinyl acetate
vinyl propionate
vinyl butyrate
and mixtures thereof.

These type B comonomers typically have an effect of reducing the solubility of the resulting copolymer. Therefore, when used, they must not be present in sufficient quantity to reduce the solubility below that required as defined above.

It will be apparent that the choice of particular type A comonomer, type B comonomer, and phosphonate moiety-containing monomer is determined by a number of factors. The degree of solubility in the carrier liquid may be controlled by proper adjustment of the ratio of type A comonomer to type B comonomer. In addition, the nature of the particular type A monomeric moiety, such as the degree of solubility of a homopolymer comprising it, will influence the particular type B monomeric moiety chosen to copolymerize with it to give the final polymer. For example, if the type A monomer is one having a relatively long alkyl group attached to it, rendering a polymer containing it relatively soluble, the type B monomer is desirably one having a relatively short alkyl group attached to it, to balance the properties. On the other hand, a relatively short alkyl group on the type A monomer in general requires a somewhat longer alkyl group on the type B monomer. Generally, as indicated above, useful polymers of the present invention are dispersible in the carrier liquid to the extent that if a 4.0 gram quantity of polymer is added to one liter of carrier, at least about 3.3 grams will remain dispersed therein after centrifuging the mixture at 34,000 G forces for about 60 minutes.

In general, the liquid developers of the invention comprising the phosphonate moiety-containing polymers described above are prepared by an addition polymerization reaction wherein all of the component monomers are combined in a reaction vessel in a reaction medium, such as dioxane, and a suitable free radical initiator. The vessel containing the solution is then flushed with an inert gas, such as nitrogen, and heated to a temperature sufficient for the polymerization reaction to proceed at a reasonable rate. The temperature, in general, is above room temperature and preferably about 40° C. to 80° C. After the polymer has formed, it is removed from the reaction mixture and purified as necessary. Polymers produced according to this procedure typically have an inherent viscosity in the range of from about 0.1 to about 0.8. The determination is made at a concentration of 0.25 grams of polymer in 100 ml. of chloroform at a temperature of 25° C. The resultant polymers contain recurring units of one or more moieties derived from type A monomers, one or more moieties derived from type B monomers, and one or more moieties derived from phosphonate moiety-containing monomers. In general, a typical polymer used in the liquid developers of the invention contains from about 35 to about 70 weight percent of type A monomers, from about 30 to about 65 weight percent of type B monomers and from about 1.5 to about 20 weight percent of phosphonate moiety-containing monomers. Preferred polymers of the invention contain from about 40–55 weight percent type A monomer, from about 35–55 weight percent of type B monomer and from 1.5–16 percent phosphonate moiety-containing monomer. The solubility of the polymer can be adjusted as desired by proper balancing of the relative abundance of the type A and type B monomers. The relative amount of phosphonate moiety containing monomer can be varied to provide polymers having different charge properties when incorporated into a liquid developer. Mechanical properties such as abrasion resistance, and fixability of the resultant toner image can also be adjusted by properly balancing the ratio of the components in the polymer.

Liquid developers containing the polymers described herein typically comprise a dispersion of the polymer in a suitable carrier liquid. A common method of preparing such a dispersion is solvent milling. A quantity of the polymer is dissolved in a suitable solvent and the solution placed in a ball mill. Pigments and other additives which may be necessary or desirable are added to the mix and the whole milled for a suitable time, typically from as long as 7 to about 15 days. Alternatively, a viscous solution of the polymer is placed on compounding rolls having chilled (5° to 10° C.) water passing through the cooling system. Pigments and other additives are then placed on the rolls and thoroughly mixed and blended with the polymer. The pigment is generally present in an amount of from about 200 to about 10 percent of the weight of the resin. After passing the complete mix through the mill several times to completely blend the ingredients, the mix is removed.

Liquid developers are made from the toner concentrate formed as above by dispersing the concentrate in a suitable electrically insulating carrier liquid. Carrier liquids which may be used to form such developers can be selected from a wide variety of materials. Preferably, the liquid has a low dielectric constant and a very high electrical resistance such that it will not disturb or destroy the electrostatic charge pattern being developed. In general, useful carrier liquids should have a dielectric constant of less than about 3, should have a volume resistivity greater than about $10^{10}$ ohm-cm and should be stable under a variety of conditions. Suitable carrier liquids include halogenated hydrocarbon solvents, for example, fluorinated lower alkanes, such as trichloromonofluoromethane, trichlorotrifluoroethane. Hydrocarbon solvents are useful, such as isoparaffinic hydrocarbons having a boiling range of from about 145° C. to about 185° C., such as Isopar G (Exxon Corporation) or cyclohydrocarbons such as cyclohexane. Additional carrier liquids which may be useful in certain situations include polysiloxanes, odorless mineral spirits, octane, etc.

Although it is possible to use the resinous phosphonate moiety-containing copolymers described herein to prepare liquid developers without further addenda, as in situations in which a colorless image is desired, it is customary to add a colorant to give the image optical density. Useful colorants can be selected from a variety of materials such as dyestuffs or pigments. Virtually any of the compounds mentioned in the "Color Index," Second Edition, 1956, Vols. I and II, may, in principle, be used. Included among the vast number of useful colorants would be such materials as Hansa Yellow G (C.I. 11680), Nigrosine Spirit soluble (C.I. 50415), Chromogen Black ETOO (C.I. 14645), Rhodamine B (C.I. 45170), Solvent Black 3 (C.I. 26150), Fuchsine N (C.I. 42510), C.I. Basic Blue 9 (C.I. 52015), etc. Another useful class of colorants is comprised of nigrosine salts of mono- and difunctional organic acids having from about 2 to about 20 carbon atoms such as chloroacetic acid, stearic acid, sebacic acid, lauric acid, azelaic acid, adipic acid, abietic acid and the like. Nigrosine salts of this type are disclosed in Olson, U.S. Pat. No. 3,647,696 issued Mar. 7, 1972.

Other colorants suitable for use in preparing liquid developers from the polymers described herein include salts of water-soluble acid dyes, more particulally the metal, alkali metal and ammonium salts of dyes having sulfonic and/or carboxylic acid groups contained thereon. Exemplary of these are the lead salt of copper phthalocyanine tetrasulfonic acid and the magnesium salt of 1-(p-sulfophenyl-3-phenyl)-4-(2.5-dichloro-4-sulfophenylazo)-5-pyrazolone. These colorants are more particularly described in Chechak, U.S. Pat. No. 3,770,638, issued Nov. 6, 1973. Particularly useful colorants are pigments prepared from the reaction of a strongly acid dye with a strongly basic dye to form a highly insoluble precipitate having essentially no color dilution. These pigments and their method of preparation are more fully disclosed in Chechak, British Pat. No. 1,343,790, issued Mar. 15, 1974.

The following preparation will illustrate a method for preparing phosphonate moiety-containing monomers that are useful for preparing the phosphonate moiety containing polymers for the liquid developers of this invention.

Preparation of Phosphonate Monomers

Ethyl hydrogen p-vinylbenzylphosphonate was made by a modification of the method of U.S. Pat. No. 3,051,740. Equimolar quantities of p-(β-chloroethyl)-benzyl chloride and triethyl phosphite were heated together at 90° for 20 hours. The mixture was distilled, taking the fraction which boiled at about 130° C. at 0.3 mm as diethyl p-(β-chloroethyl)benzylphosphonate. This ester was heated at reflux for 2 hours in ethanol containing twice its molar amount of potassium hydroxide. The mixture was diluted with five volumes of water and extracted with benzene. The aqueous solution was made strongly acid and the oil which separated was taken up in ether. The residue which remained from the evaporation of the ether was extracted with several portions of hot ligroine. The product, ethyl hydrogen p-vinylbenzylphosphonate, crystallized from the ligroine. Recrystallization from ligroine gave material of m.p. 85°–86° C. (corr.).

Anal. Calc'd for: $C_{11}H_{15}O_3P$; C, 58.4; H, 6.6. Found: C, 58.2; H, 6.7.

Vinylphosphonic acid was made by hydrolysis of vinylphosphonic acid dichloride by the method described in German Pat. No. 1,023,033, which in turn was made by the method described in German Pat. No. 1,023,034. To bis-β-chloroethyl vinylphosphonate (Stauffer Chemical Co.), heated to 120° C., was added twice the molar quantity of phosphorous pentachloride in small portions. Distillation at 10 mm gave vinylphosphonic acid dichloride at about 55° C.

The dichloride was added dropwise to water at 10° C. and the mixture was stirred for an hour at room temperature. After extraction with chloroform, the aqueous solution was evaporated to dryness to yield vinylphosphonic acid as a colorless oil.

Other phosphonic acid monomers can be readily prepared by those skilled in the art by making appropriate changes in the starting materials using the above-described procedures or by using other state of the art procedures.

The following examples are included for a further understanding of the invention.

The following examples are included for a further understanding of the invention. Unless otherwise indicated in the examples all percentages are weight percents. Also the numbers immediately following the name of a copolymer indicates the percent by weight of the respective monomers in that copolymer. For instance, poly(vinyltoluene-co-lauryl methacrylate-co-ethyl hydrogen p-vinyl(benzylphosphonate) 47/47/6 consists of 47 weight percent vinyltoluene monomers, 47 weight percent lauryl methacrylate monomers, and 6 weight percent ethyl hydrogen p-vinylbenzylphosphonate monomers.

EXAMPLE 1

Poly(vinyltoluene-co-lauryl methacrylate-co-ethyl hydrogen p-vinylbenzylphosphonate) 47/47/6

Fifteen grams of vinyltoluene, 15 g of lauryl methacrylate, 1.9 g of ethyl hydrogen p-vinylbenzylphosphonate, and 1.2 g of lauroyl peroxide were dissolved in 15 ml of dioxane, flushed with nitrogen and polymerized at 65° C. for above 60 hours. After dilution with dioxane, the solution was poured into water to precipitate the sticky polymer. The water was removed by azeotropic distillation, and the benzene solution was dried to yield the solid polymer.

Anal. Calc'd: P, 0.8; Found: P, 0.8.

EXAMPLE 2

Poly(vinyltoluene-co-lauryl methacrylate-co-ethyl lithium p-vinylbenzylphosphonate) 47/47/6

A polymerization was conducted as described in the previous example. Prior to precipitation, a methanol solution of lithium hydroxide equivalent to 90% of the phosphonic acid was added. The polymer was recovered as before.

Anal. Calc'd for 90% neutralization: Li, 0.17. Found: Li, 0.16.

EXAMPLE 3

Poly(vinyltoluene-co-lauryl methacrylate-co-1-hydroxy-1-methyl-2-propenylphosphonic acid) 50/45/5

The procedure of Marvel and Wright [*J. Poly. Sci.*, 8, 495 (1952)] was followed for the addition of phosphorus trichloride to a carbonyl-containing polymer followed by hydrolysis to yield a hydroxyphosphonic acid. A terpolymer of vinyltoluene (25 g), lauryl methacrylate (22.5 g), and methyl vinyl ketone (2.5 g) was made by heating these monomers with 1 g of azobisisobutyronitrile in dioxane at 65° for 24 hours. The polymer was recovered by precipitation in methanol.

To 10 g of the above terpolymer in 100 ml of dry dioxane was added 8 ml of phosphorus trichloride. After 24 hours, 12 ml of acetic acid was stirred in. This mixture was allowed to stand three days then poured into water to precipitate the product. It was dried and reprecipitated in water from dioxane. Water was removed by azeotropic distillation with benzene, and drying was completed in vacuum.

Anal: Found: P, 1.0.

EXAMPLE 4

Poly(vinyltoluene-co-lauryl methacrylate-co-vinylphosphonic acid) 51/48/1

A mixture of 25 g vinyltoluene, 23.5 g lauryl methacrylate, 1.5 g vinylphosphonic acid, 2 g lauroyl peroxide and 30 ml dioxane was flushed with nitrogen and polymerized at 65° C. After dilution with dioxane, the solution was poured into methanol to precipitate the polymer. Residual methanol was removed by azeotropic distillation with benzene, and the polymer was dried in vacuum. Phosphorous content was 0.3% by analysis. This corresponds to 1% vinylphosphonic acid.

EXAMPLE 5

Poly(vinyltoluene-co-lauryl methacrylate-co-lithium hydrogen vinylphosphonate) 51/48/1

To a solution in THF of 10 g (1 mmol of acid) of the vinylphosphonic acid polymer of the previous example was added a methanolic solution of 0.93 meq of lithium hydroxide. The polymer was precipitated in water, residual water was removed by an azeotropic distillation with benzene, and the polymer was dried in vacuum.

EXAMPLE 6

A concentrated liquid toner was prepared by dissolving 8 parts by weight of poly(vinyltoluene-co-lauryl methacrylate-co-ethyl hydrogen p-vinylbenzylphosphonate) 47/47/6 in 86 parts (by weight) of Solvesso-100 (Exxon Corporation) and then adding 6 parts (by weight) of Peerless 155 carbon (Columbian Carbon Co.) followed by ballmilling of the mixture for 15 days using ⅛ inch steel balls.

A working strength liquid developer was then prepared by mixing enough of the above-described concentrate in Isopar-G under ultrasonic shear to yield a pigment content of 0.5 g/l. The developer had particle size $\leqq 1.5\mu$, and when used in the conventional electrophotographic process provided good image quality. The developer was negatively charged.

EXAMPLE 7

A concentrated liquid toner was prepared by dissolving 6 parts (by weight) of the polymer used in Example 6 above in 88 parts (by weight) of Isopar-G and then adding 6 parts (by weight) of Raven 1255 Carbon (Columbian Carbon Co.) followed by ballmilling of the mixture for 15 days using ⅛ inch steel balls. A developer was prepared as in Example 6, except no shear was used to disperse the toner. The images obtained on ZnO paper were of good quality, acceptable density, and clean background. The toner was negatively charged.

EXAMPLE 8

A concentrated liquid developer was prepared as in Example 7, except that the carbon pigment was replaced by the cyan pigment, Monolite Blue 3R (ICI United States, Inc.). The developer prepared from this concentrate was negatively charged, had particle size $2\mu$, and produced excellent image quality when tested in the conventional electrographic process.

EXAMPLE 9

A concentrated liquid toner was prepared by dissolving 8 parts (by weight) of poly(vinyltoluene-co-lauryl methacrylate-co-ethyl hydrogen-p-vinylbenzylphosphonate 90% lithium salt) 47/47/6 in 86 parts (by weight) of Solvesso-100 and then adding 6 parts (by weight) of Peerless 155 carbon black, followed by ballmilling of the mixture for 15 days using ⅛ inch steel balls. A developer was prepared as in Example 7 and tested. It was negatively charged and produced good quality, high density images.

EXAMPLE 10

A concentrated liquid toner was prepared as in Example 6, except the polymer used was a phosphorylated poly(vinyltoluene-co-lauryl methacrylate-co-methyl vinyl ketone). A developer was prepared as in Example 7. The images obtained on an organic photoconductor layer had good density and clean background. The developer was negatively charged.

EXAMPLE 11

Concentrated liquid toners were also prepared as in Example 10 using as the polymer, unphosphorylated poly(vinyltoluene-co-lauryl methacrylate-co-methyl vinyl ketone). The images obtained from the corresponding developer were all of poor quality, high background and smeared.

EXAMPLE 12

A concentrated liquid toner was prepared as in Example 7, except that poly(vinyltoluene-co-lauryl methacrylate-co-vinylphosphoric acid) was used as the charging polymer. The corresponding developer yielded good quality and high density images on organic photoconductor elements.

EXAMPLE 13

A concentrated liquid toner was prepared as in Example 7, except that the lithium salt of poly(vinyltoluene-co-lauryl methacrylate-co-vinylphosphonic acid) was used as the charging polymer. The developer produced high density, good quality images with organic photoconductor elements.

EXAMPLE 14

This example compares a liquid developer of the present invention with a prior art liquid developer containing a bivalent metal salt of a phosphorus oxyacid containing an organic residue as described in British Pat. No. 1,151,141.

Copper(II) lauryl phosphonate was prepared as described on page 2 of British Pat. No. 1,151,141. A concentrated liquid toner was prepared in the same manner as in Example 6 except that copper(II) laurylphosphonate was substituted for the phosphonic acid group-containing polymer and Raven 1255 carbon black was used as the colorant.

A second concentrated liquid toner was prepared the same as above except using poly(vinyltoluene-co-lauryl methacrylate-co-ethyl hydrogen p-vinylbenzylphosphonate;50:47:3) in accord with the teachings of the present invention.

Working strength liquid developers were made in the same manner as described in Example 6 and electrographic images were developed. The following comparisons were noted:

| Developer | Prior Art | Present Invention |
|---|---|---|
| Particle size: | agglomerate up to $15\mu$ | agglomerate up to $3\mu$ |
| Toner Polarity: | positively charged | negatively charged |
| Developer Stability: | considerable particle sedimentation after one week storage | no particle sedimentation noted after one week storage |
| Image quality: | very fuzzy and grainy | high quality, good resolution |

The invention has been described in detail with particular reference to certain preferred embodiments thereof, but it will be understood that variations and modifications can be effected within the spirit and scope of the invention.

We claim:

1. A liquid electrographic developer comprising colorant particles dispersed in an electrically insulating carrier liquid and a soluble vinyl polymeric dispersing agent containing a phosphonate moiety wherein said moiety is a phosphonic acid group, a phosphonic salt group, a half-ester of a phosphonic acid group, or a salt of a half-ester of a phosphonic acid group, the solubility ratio of said polymeric dispersing agent in the carrier liquid being at least about 0.825.

2. The liquid electrographic developer as described in claim 1 wherein said polymeric dispersing agent contains phosphorus in an amount of from about 0.1 to about 10 percent by weight.

3. A liquid electrographic developer comprising colorant particles dispersed in an electrically insulating carrier liquid and a soluble vinyl polymeric dispersing agent comprising repeating units of a phosphonate group-containing vinyl monomer wherein said monomer is:

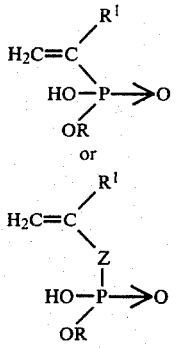

wherein:

R is hydrogen, an alkyl group, or an aryl group;

$R^1$ is hydrogen or a lower alkyl group having from 1 to about 4 carbon atoms; and Z is an alkylene group or an arylene group, the solubility ratio of said polymeric dispersing agent in the carrier liquid being at least about 0.825.

4. The liquid electrographic developer as described in claim 3 wherein said polymeric dispersing agent comprises from about 1.5 to about 20 weight percent of repeating units derived from said phosphonate group-containing monomer.

5. The liquid electrographic developer as described in claim 4 wherein said phosphonate group-containing monomer is selected from the group consisting of vinylphosphonic acid, lithium hydrogen vinylphosphonate, ethyl hydrogen p-vinylbenzylphosphonate, ethyl lithium p-vinylbenzylphosphonate, and 1-hydroxy-1-methyl-2-propenyl-phosphonic acid.

6. A liquid electrographic developer comprising colorant particles dispersed in an electrically insulating carrier liquid and a soluble vinyl polymeric dispersing agent comprised of units obtained by polymerizing (1) a vinyl monomer containing a phosphonate moiety wherein said moiety is a phosphonic acid group, a phosphonic salt group, a half-ester of a phosphonic acid group, or a salt of a half-ester of a phosphonic acid group and (2) a vinyl comonomer selected from the group consisting of alkyl styrenes having from about 3 to about 10 carbon atoms in the alkyl moiety;

alkoxy styrenes having from about 3 to about 10 carbon atoms in the alkyl moiety;

alkyl acrylates having from about 8 to about 22 carbon atoms in the alkyl moiety;

alkyl methacrylates having from about 8 to about 22 carbon atoms in the alkyl moiety;

vinyl alkyl ethers having from about 8 to about 22 carbon atoms in the alkyl moiety; and vinyl esters of alkanoic acids having from about 6 to about 22 carbon atoms in the alkyl moiety; and mixtures thereof, the solubility ratio of said polymeric dispersing agent in the carrier liquid being at least about 0.825.

7. The liquid electrographic developers as described in claim 6 wherein said comonomer (2) is present in said polymeric dispersing agent to the extent of at least about 35 weight percent.

8. The liquid electrographic developer as described in claim 6 wherein said comonomer (2) is selected from the group consisting of alkyl styrenes having from about 5 to about 10 carbon atoms in the alkyl moiety;

alkyl acrylates and methacrylates having from about 12 to about 22 carbon atoms in the alkyl moiety; and vinyl esters of alkanoic acids having from about 10 to about 22 carbon atoms in the alkyl moiety; the mixtures thereof.

9. A liquid electrographic developer comprising colorant particles dispersed in an electrically insulating carrier liquid and a soluble vinyl polymeric dispersing agent obtained by polymerizing (1) a vinyl monomer containing a phosphonate moiety wherein said moiety is a phosphonic acid group, a phosphonic salt group, a half-ester of a phosphonic acid group, or a salt of a half-ester of a phosphonic acid group; (2) a vinyl comonomer selected from the group consisting of alkyl styrenes having from about 3 to about 10 carbon atoms in the alkyl moiety;

alkoxy styrenes having from about 3 to about 10 carbon atoms in the alkyl moiety;

alkyl acrylates having from about 8 to about 22 carbon atoms in the alkyl moiety;

alkyl methacrylates having from about 8 to about 22 carbon atoms in the alkyl moiety;

vinyl alkyl ethers having from about 8 to about 22 carbon atoms in the alkyl moiety; and vinyl esters of alkanoic acids having from about 6 to about 22 carbon atoms in the alkyl moiety; and (3) a vinyl comonomer selected from the group consisting of:

styrene, methyl styrene, methoxy styrene and halogenated styrene;

alkyl acrylates having from about 1 to about 4 carbon atoms in the alkyl moiety;

alkyl methacrylates having from 1 to about 4 carbon atoms in the alkyl moiety;

vinyl alkyl ethers having from 1 to about 4 carbon atoms in the alkyl moiety; and vinyl esters of alkanoic acids having from about 1 to about 4 carbon atoms in the alkyl moiety; and mixtures thereof, the solubility ratio of said polymeric dispersing agent in the carrier liquid being at least about 0.825.

10. The liquid electrographic developer as described in claim 9 wherein said polymeric dispersing agent comprises from about 1.5 to about 20 weight percent of phosphonate group-containing monomer, from about 35 to about 70 weight percent of monomer (2), and from about 30 to about 65 weight percent of comonomer (3).

11. The liquid electrographic developer as described in claim 10 wherein said comonomer (2) is selected from the group consisting of:

alkyl styrenes having from about 5 to about 10 carbon atoms in the alkyl moiety;

alkyl acrylates and methacrylates having from about 12 to about 22 carbon atoms in the alkyl moiety; and vinyl esters of aliphatic acids having from about 10 to about 22 carbon atoms in the alkyl moiety;

and said comonomer (3) is selected from the group consisting of:

styrene and methyl styrene;

alkyl acrylates having from 1 to about 4 carbon atoms in the alkyl moiety;

alkyl methacrylates having from 1 to about 4 carbon atoms in the alkyl moiety; and vinyl esters of alkanoic acids having from 1 to about 4 carbon atoms in the alkyl moiety;

and mixtures thereof.

12. The liquid electrographic developer as described in claim 11 wherein said polymeric dispersing agent comprises from about 1.5 to about 16 weight percent of phosphonate group-containing monomer, from about 40 to about 55 weight percent of comonomer (2), and from about 35 to about 55 weight percent of comonomer (3).

* * * * *